United States Patent [19]

Simjian

[11] Patent Number: 4,743,027

[45] Date of Patent: May 10, 1988

[54] GOLF PRACTICE PUTTING DEVICE

[75] Inventor: Luther G. Simjian, Fort Lauderdale, Fla.

[73] Assignee: Command Automation, Inc., Fort Lauderdale, Fla.

[21] Appl. No.: 34,478

[22] Filed: Apr. 2, 1987

[51] Int. Cl.[4] ..... A63B 67/02

[52] U.S. Cl. ..... 273/178 R; 273/176 H; 273/DIG. 31

[58] Field of Search ..... 273/176 R, 176 H, 176 E, 273/176 B, 177 R, 177 A, 178 R, 178 B, 195 R, 195 B, 34 R, 183 A, 176 FA, DIG. 31

[56] References Cited

U.S. PATENT DOCUMENTS 1,612,291 12/1925 Jackson ..... 273/178 B
2,118,084 5/1938 Heinzelmann ..... 273/176 H
4,222,568 9/1980 Russo ..... 273/176 H
4,247,112 1/1981 Del Raso ..... 273/176 H

*Primary Examiner*—Richard C. Pinkham
*Assistant Examiner*—William E. Stoll

[57] ABSTRACT

A golf putting device having an inclined ramp and an abutting normally plane surface having a hole for receiving a golf ball stroked toward the hole and traversing the ramp and plane surface. Lifting rods are disposed for cooperating with the normally plane surface for distorting the normally plane surface. In a typical example, the mat covering the plane surface is slightly elevated at one location by one of the lifting rods disposed underneath the mat. A control handle and slide rod are coupled to the lifting rods to control the amount of elevation as well as the location in the horizontal plane.

7 Claims, 2 Drawing Sheets

GOLF PRACTICE PUTTING DEVICE

BRIEF SUMMARY OF THE INVENTION

This invention refers to a golf practice putting device and more particularly, relates to a golf practice putting device wherein a golf ball is stroked across a substantially plane or level surface toward a hole disposed in such surface. Devices of this type are used primarily indoors for putting practice and competitive play. Quite specifically, the present invention concerns a golf practice putting device of the type indicated wherein the normally plane surface containing the hole can be slightly distorted in order to enhance the skill aspect of the device and to provide a more challenging and interesting device to a person or persons using such a putting device for either skill improvement or competitive play.

A golf practice putting device in which a golf ball is stroked up a ramp toward a plane surface provided with an aperture and hole for receiving therein one or more golf balls is shown, for instance, in my previously issued U.S. Pat. No. 4,634,130, dated Jan. 6, 1987, entitled, "Golf Practice Putting Device." Balls entering the hole or cup are stored in one compartment whereas balls rolling past the location of the hole are received in a transverse trough and then stored in a second compartment. The device is covered with a mat for simulating visually a golf green and also to provide friction to the motion of the ball as is experienced when a golf ball is stroked across a grass surface, particularly a putting green.

The present invention is an improvement in that means are provided to distort the normally plane playing surface. Quite specifically, by providing adjustable lifting means, which are adapted to engage the underside of the mat, the normally plane surface of the mat is distorted so as to make the putting more difficult and challenging. The lifting means comprises one or more adjustable lifting rods which slightly elevate the mat at one or more locations relative to the surrounding surface. It will be apparent that such a change in level generally will be in the order of one inch or less, but by virtue of control means, the lifting rod can be set to suit individual tastes. In addition, the lifting means shown are adjustable radially about the vertical axis of the hole into which the golf ball is to enter.

One of the principal objects of this invention is the provision of a new and improved golf practice putting device.

Another important object of this invention is the provision of a new and improved golf practice putting device which includes for enhancing the skill of the golfer.

Another important object of this invention is the provision of a golf practice putting device having a normally plane surface, an aperture in such surface for providing a hole for receiving a golf ball therein and means for distorting the surface across which the golf ball rolls from its normally plane condition.

A further important object of this invention is the provision of a golf practice putting device having a normally level of plane mat covered surface across which a ball is stroked, an aperture disposed in such mat and surface for providing a hole for receiving therein one or more golf balls, and one or more lifting means disposed underneath such mat for distorting the matted surface from its normally plane condition by slightly elevating the mat at one or more locations.

Further and still other objects of this invention will become more clearly apparent by reference to the following description when read in conjunction with the accompanying drawings.

DETAILED DESCRIPTION OF THE INVENTION

Figure 1:
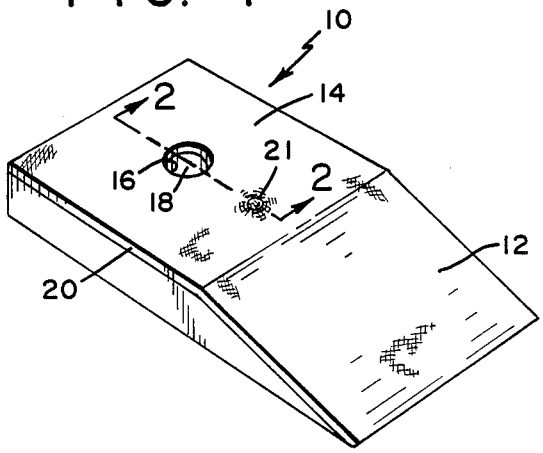
FIG. 1 is a prespective view of the new golf practice putting device.

Referring now to the figures and FIG. 1 in particular, numeral 10 denotes the new and improved golf practice putting device comprising an inclined ramp 12 and an abutting normally substantially plane surface 14 which is provided with an aperture 16 for forming a hole 18 into which a golf ball is to drop, thereby simulating the hole found on a conventional golf course. The ramp and plane surface are covered by a mat 20 for providing the appearance and friction of a golf green when a golf ball is putted toward the hole 18 by rolling up the ramp 12 and across the surface 14.

Figure 2:
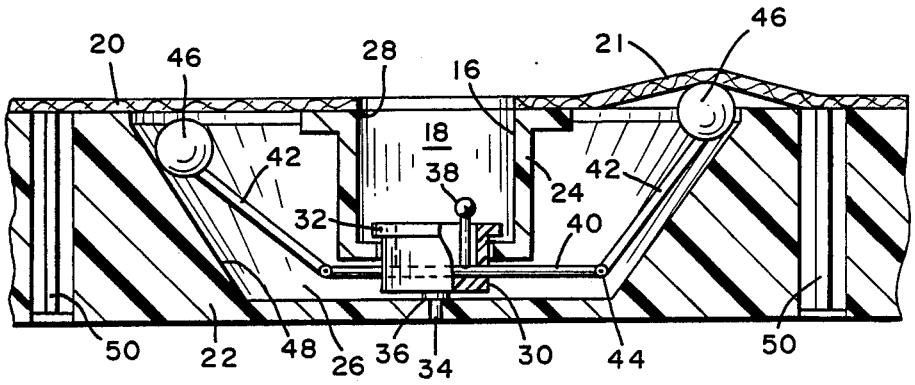
FIG. 2 is a sectional view along line 2-2 in FIG. 1.
Figure 3:
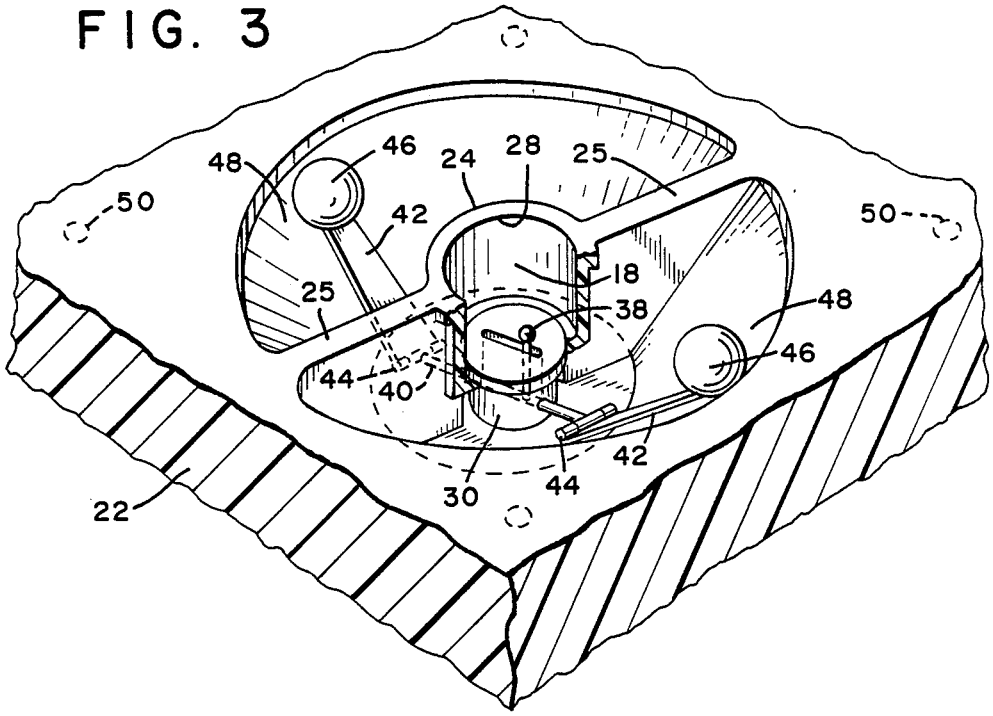
FIG. 3 is a perspective view of the lifting means as seen in FIG. 2.

Referring now to FIGS. 2 and 3, the golf practice putting device comprises, in a typical embodiment, a molded plastic support 22, the mat 20 covering the upper surfaces. The hole 18 is formed by a cup 24 which is disposed in the cavity 26 of the support 22 and held by ribs 25 extending from support 22. The mat 20 covers the cavity 26 and terminates at the rim 28 of the aperture 16 which is the inner diameter of the cup 24 in order to provide a continuous playing surface up to the hole 18. Inside the hole 18 and extending through the perforated bottom of the cup 24 there is disposed a cup 30 having a slotted cover 32. The cup 30 is mounted also for rotation about its vertical axis by means of a pin 34 and flat washer 36. A control means 38, e.g. a control rod, extends through the slot in the cover 32 and is coupled at its lower end to a horizontally disposed slide rod 40 adapted for reciprocating motion responsive to the operation of the control means 38. A respective lifting rod 42 is pivotally coupled to each end of the slide rod 40 by means of a respective hinge 44. The top of each lifting rod 42 may be provided with a spherical element 46 for engaging the underside of the mat 20. As the control means 38 is moved in the slot of the cover 32, the spherical elements 46 ride and down respectively along the inclined wall 48 of the cavity 26 in the support 22. As shown in FIG. 2, when the control means 38 is moved toward the right, the right lifting rod 42 causes the associated spherical element 46 to slightly elevate the mat 20 at the location 21. If the control means 38 is moved toward the left, as seen in FIG. 2, the right spherical element 46 is lowered into the cavity 26 by sliding down along the wall 48, while the left spherical element 46 rises on account of the slide rod 40 moving toward the left and the obtuse angle between the slide rod 40 and the left lifting rod decreases toward a right angle. By moving the control means 38 between its extreme positions, various elevational levels of the mat can be achieved. Suitable friction in the hinges 44 causes the adjusted portion to be retained. Otherwise locking means, not shown, need to be provided. Most suitably, the maximum elevation of the mat at the localized spot is adjusted to not exceed one inch. By rotating the cup 30 about its central axis, the localized raising of the mat can be adjusted in the substantially horizontal plane relative to the vertical axis through the hole 18.

A set of four elastic bands 50 is anchored with one end to the support 22 and with the opposite end to the mat 20 in order to urge the mat toward covering the support 22 and to restore the mat toward its normally plane position after being elevated by the action of the lifting rods.

Figure 4:
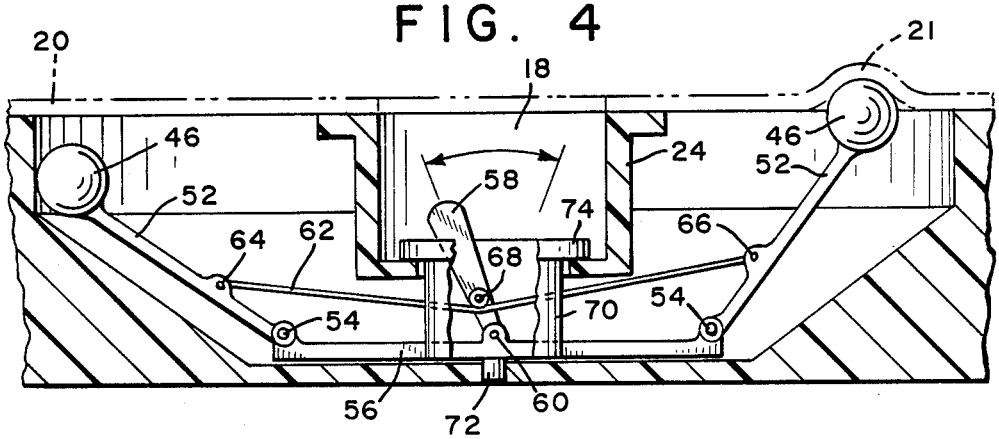
FIG. 4 is an elevational view, partly in section, showing an alternative lifting means.

An alternative embodiment of the linkage mechanism for elevating the mat for distorting the normally plane playing surface is shown in FIG. 4. Identifying only the most pertinent elements of the means for changing the elevation of the mat, a pair of lifting rods 52 is coupled to respective hinges 54 which are attached to respective ends of a horizontally disposed stationary cross bar 56 extending through the cup 70. A control means, i.e. a lever 58, is coupled to the cross bar 56 with one end for pivoting motion about pivot 60. A flexible band 62 is fastened with one end to lifting rod 52 at connection 64, and the other end of band 62 is fastened to the other lifting rod at connection 66. The band 62 is engaged by roller 68 secured to the control lever 58. As the lever 58 is pivoted about pivot 60, the roller 68 moves along the band 62 to cause the mat to become elevated or lowered, see numeral 21, on one or the other side. The cup 70 again is mounted for rotation in the support 22 by means of pin 72 in order to elevate positions of the mat along a horizontal orientation relative to the axis of hole 18. The cover 74 of the cup 70 is slotted as shown in connected with the embodiment per FIGS. 2 and 3.

While there has been described and illustrated a preferred embodiment of my invention, including an alternative embodiment thereof, it will be apparent to those skilled in the art that additional changes and modification may be made without departing from the spirit of my invention which shall be limited only by the scope of the appended claims.

What is claimed is:

1. A golf practice putting device comprising:

a support for providing an inclined ramp portion and an abutting normally level portion;

a mat covering said normally level portion;

an aperture disposed in said mat and support at said normally level portion for receiving therein a golf ball rolling over said normally level portion;

means for engaging the underside of said mat coupled to said support for elevating a localized portion of said mat at said normally level portion for distorting said mat from its normally level position, and control means, accessible via said aperture coupled to said means for engaging said mat for controlling the elevation of said localized portion.

2. A golf practice putting device comprising:

a support for providing an inclined ramp portion and an abutting normally level portion;

a mat covering said normally level portion;

an aperture disposed in said mat and support at said normally level portion for receiving therein a golf ball rolling over said normally level portion;

a movably mounted lifting rod adapted to engage the underside of said mat coupled to said support for elevating a localized portion of said mat at said mormally level portion for distorting said mat from its normally level position, and control means, accessible via said aperture, coupled to said lifting rod for controlling the elevation of said lifting rod relative to said support.

3. A golf practice putting device as set forth in claim 2, said lifting rod being pivotally mounted with one end to a slide rod, and said control means coupled to said slide rod for controlling the elevation of the other end of said lifting rod.

4. A golf practice putting device as set forth in claim 2, and means disposed on said support for causing said lifting rod to be rotatable about a substantially vertical axis through said aperture.

5. A golf practice putting device comprising:

a support for providing an inclined ramp portion and an abutting normally level portion;

a mat covering said normally level portion;

an aperture disposed in said mat and support at said normally level portion for receiving therein a golf ball rolling over said normally level portion;

at least one pivotally mounted lifting rod coupled to said support for elevating a localized portion of said mat at said normally level portion for distorting said mat from its normally level position, and control means including a pivotally mounted lever, accessible via said aperture, coupled to one end of said rod lifting rod for causing pivotal motion of said rod responsive to the operation of said lever, whereby to control the elevation of said lifting rod relative to said support.

6. A golf practice putting device as set forth in claim 5, the other end of said lifting rod provided with a substantially spherical member.

7. A golf practice putting device as set forth in claim 5, and means operative between said support and said mat for urging an elevated portion of said mat toward said support.

* * * * *